US006199495B1

(12) United States Patent
Schafer

(10) Patent No.: US 6,199,495 B1
(45) Date of Patent: Mar. 13, 2001

(54) METHOD AND APPARATUS FOR SEWING AND CUTTING LAYERED CLOTH

(76) Inventor: Margaret D. Schafer, 504 East Fairhaven, Suite 210, Burlington, WA (US) 98233

( * ) Notice: Subject to any disclaimer, the term of this patent is extended or adjusted under 35 U.S.C. 154(b) by 0 days.

(21) Appl. No.: 09/314,032

(22) Filed: May 18, 1999

Related U.S. Application Data

(60) Provisional application No. 60/086,054, filed on May 19, 1998.

(51) Int. Cl.[7] ..... D05B 35/10; D05C 17/00

(52) U.S. Cl. ..... 112/475.23; 112/439; 112/440; 112/409

(58) Field of Search ..... 112/475.01, 405, 112/417, 418, 427, 428, 432, 439, 127, 130, 475.22, 475.23, 437, 475.18; 28/145, 146

(56) References Cited

U.S. PATENT DOCUMENTS

| | | | | |
|---|---|---|---|---|
| 1,560,283 | * | 11/1925 | Mehlem | 112/437 |
| 2,155,212 | * | 4/1939 | Zenorini | 112/475.22 |
| 3,226,732 | * | 1/1966 | Zerilli | 112/405 X |
| 3,771,479 | * | 11/1973 | Mavis | 112/439 |
| 6,101,962 | * | 8/2000 | Hinshaw | 112/439 X |

* cited by examiner

*Primary Examiner*—Ismael Izaguirre
(74) *Attorney, Agent, or Firm*—E. Russell Tarleton; Seep IP Law Group PLLC

(57) ABSTRACT

A method and apparatus for sewing and cutting layered cloth wherein a sewing guide formed of at least semi-rigid, compliant material is used to guide the stitching of parallel lines to create channels within which the sewing guide is placed to act as a cutting mat when cutting the layers of fabric above the sewing guide, such as with a rotary cutting tool.

21 Claims, 4 Drawing Sheets

METHOD AND APPARATUS FOR SEWING AND CUTTING LAYERED CLOTH

CROSS-REFERENCE TO RELATED APPLICATION

The present invention claims the benefit of U.S. Provisional Patent Application No. 60/086,054, filed May 19, 1998, entitled METHOD AND APPARATUS FOR SEWING LAYERED CLOTH.

TECHNICAL FIELD OF THE INVENTION

The present invention pertains to sewing methods and tools for creating textured material, and, more particularly, to a method and apparatus for sewing and cutting fabric using a layering-and-slashing technique.

BACKGROUND OF THE INVENTION

Layering and slashing fabric to create innovative textures and color combinations has been known since the days of the Renaissance. This technique has been adopted to create textured clothing that resembles chenille fabric. The look and feel of this fabric can take on different characteristics, depending on the fabric patterns and colors used in the design, as well as the type of fabrics and the order in which the fabrics are layered.

One modern method that is known for creating a chenille-type fabric involves the following steps. Multiple layers of cloth are stacked on top of each other. For instance, six different layers can be used, and these may be a combination of solid colors and prints, and may even be of different fibers (for example, cotton and rayon). In this example, the cloth layers are formed from six-inch squares.

Next, a 45 degree angle is marked from corner to corner on the stack of layered cloth. The 45 degree line is then used as a guide for stitching through all layers of cloth along the line. After the row of stitching is complete, a second stitch is then sewn parallel to the first row of stitching, preferably spaced five-eighths of an inch (1.5 cm) apart to create a channel. Additional parallel rows are stitched on the fabric until the entire stack of layered cloth is stitched into parallel channels. Blunt-tipped scissors are then used to cut through the top layers between the stitching rows. The base layer of cloth is not cut. This results in several rows of parallel strips of fabric sewn to the base layer.

Finally, the cut stack of cloth is soaked with water and wrung out. The fabric is then rubbed and agitated as much as possible and dried. Depending on the order in which the cloth layers were stacked and the type of fabric chosen, the resulting material will vary from a soft, fluffy feel, to a subtle naturally-mottled pattern.

One disadvantage with the prior method is that it requires the use of scissors to cut through five layers of cloth without cutting through the sixth or bottom layer of cloth. Great effort may sometimes be required to use scissors to cut all the layers of fabric at one time. While each layer can separately be cut along each row, it would require passing the scissors along the row five times, or as many times as there are layers, in order to effectuate a cut down to the base layer. Separately cutting each layer would make it difficult to have each layer cut along the same line, resulting in unevenness in the dimensions. Hence, there is a need for a faster and easier method for cutting the upper layers of cloth without cutting the base layer.

SUMMARY OF THE INVENTION

The present invention is directed to a method and apparatus for sewing and cutting multiple layers of fabric in evenly-spaced parallel rows. In accordance with one method of the present invention, a strip of at least semi-rigid material is used as a guide for creating parallel rows of stitching on multiple layers of cloth. Multiple layers of cloth are stacked and one row of stitching is placed through all of the layers along a marked line. The strip of material is then placed on the layered cloth and used as a guide for a second parallel row of stitching. Ideally, the stitching guide is place one-eighth of an inch from the previous row of stitching. Using a zipper foot on a sewing machine, the needle position is moved to the edge of the zipper foot, next to the stitching guide. A row of stitching is then formed by running the edge of the zipper foot close to the stitching guide, but leaving enough space for the needle to stitch the fabric. The two parallel rows of stitching create a channel having dimensions that permits the insertion of the stitching guide.

In accordance with another method of the present invention, the stitching guide is inserted in a channel formed in the fabric and used as a cutting mat or strip for cutting one or more layers of the multiple layers of cloth. In particular, after a channel is created by stitching as described above, a cutting tool, such as a rotary cutter, is run along the top of the channel where the desired cut is to be made. The stitching guide inside the channel functions as a cutting strip on which the rotary cutting tool bears against for cutting the top layers of cloth while protecting the lower layer or layers of cloth.

In accordance with yet another aspect of the invention, the stitching guide is formed from a strip of compliant, semi-rigid material of suitable thickness and hardness to act as a stitching guide and cutting mat. The guide is formed of a predetermined width to create channels of desired width in the cloth. In accordance with another aspect of the present invention, the stitching guide can be formed with rounded comers to facilitate insertion into a fabric channel.

In accordance with a further aspect of the invention, a stitching guide is used in the stitched channel and a ruler of sufficient thickness is placed on top of the cloth and the stitching guide to be used as a cutting guide for a cutting tool, such as a rotary cutter.

As will be readily appreciated from the foregoing, the invention facilitates the sewing and slashing of multiple layers of cloth, such as to create a chenille-type fabric. The use of scissors for cutting the multiple layers of cloth is no longer required. In addition, the use of modem rotary cutting tools will speed up and simplify the cutting of multiple layers of cloth in a straight line as described above. The stitching guide also aids in creating perfectly parallel rows of stitching and functions as a cutting mat or cutting strip for slashing with a rotary cutter between the rows of stitching.

BRIEF DESCRIPTION OF THE DRAWINGS

The foregoing and other features of the present invention will be more readily appreciated as the same become better understood from the following detailed description when taken in conjunction with the following drawings, wherein.

DETAILED DESCRIPTION OF THE INVENTION

Figure 1:
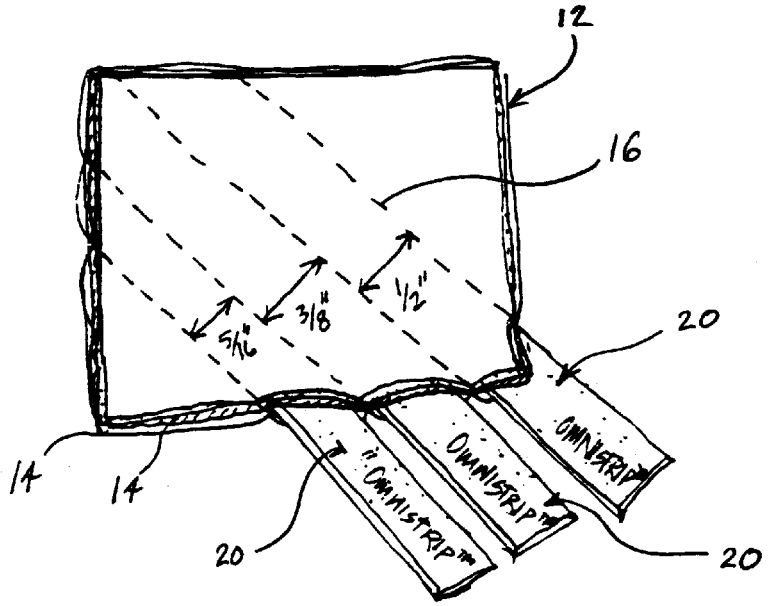
FIG. 1 is an isometric projection of a plurality of stitching guides inserted within channels formed in multiple layers of cloth stitched together in accordance with the present invention.

Representative embodiments of the methods and apparatus of the invention will now be described in conjunction with FIGS. 1–10. Referring initially to FIG. 1, show therein is a stack of fabric 12 formed from multiple layers of cloth 14. The fabric stack 12 is stitched together with rows of stitching 16 to form multiple channels 18 in the fabric stack 12.

A stitching guide 20 is placed on the layers of cloth 14 to position the rows of stitching 16 a predetermined distance apart. The distance is determined by the width of the stitching guide 20, as shown in FIG. 1, which may be in the range of one-eighth of an inch to one inch, and larger, but generally five-sixteenths of an inch, three-eighths of an inch, or one-half inch. Other widths may also be used, such as one-fourth of an inch and five-eighths of an inch. It is to understood that the invention is not to be limited by the foregoing dimensions and other dimensions may be used, in metric or in English units, as desired.

Figure 2:
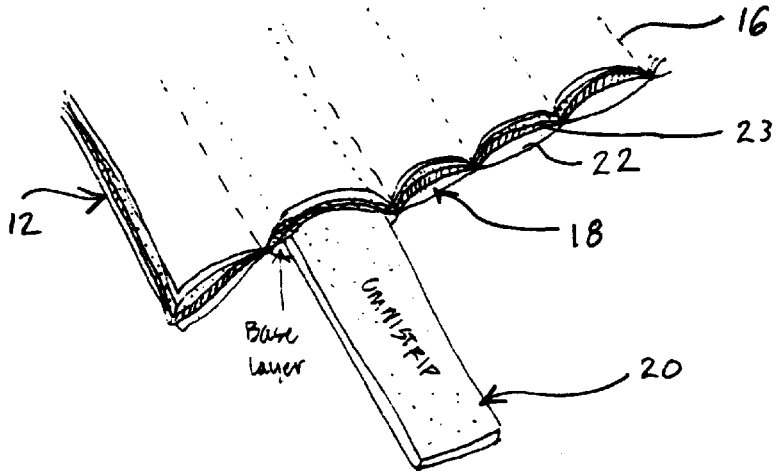
FIG. 2 is an isometric projection of a stitching guide inserted between a base layer of cloth and multiple layers of additional cloth in accordance with the method of the invention.
Figure 3:
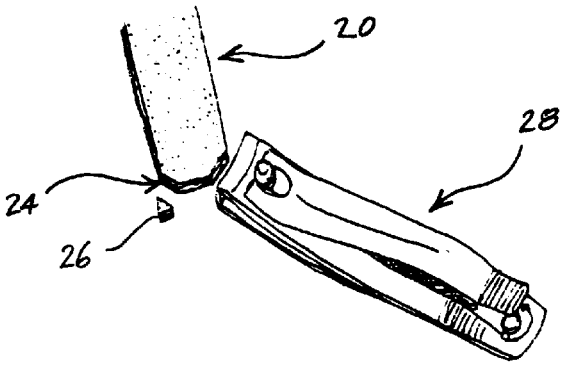
FIG. 3 is an isometric projection of one method for forming rounded corners on the stitching guide of the invention.

FIG. 2 illustrates the positioning of the stitching guide 20 for cutting one or more layers of cloth 14. As shown herein, the stitching guide 20 is positioned above a base layer 22 of cloth 14 and beneath the other layers 23 of cloth 14. To facilitate sliding of the stitching guide 20 into the channels 18, at least one end 24 of the stitching guide 20 may be rounded by clipping the corners 26 therefrom, such as with a nail clipper 28, as shown in FIG. 3.

Preferably, the stitching guide 20 is formed to have an elongate shape with a width and length to be determined by the particular application. In this case, the width is shown as either five-sixteenths of an inch, three-eighths of an inch, or one-half inch. The stitching guide 20 is ideally formed from compliant, at least semi-rigid material with sufficient rigidity to not bend under its own weight, such as when it projects beyond a supporting surface, yet resilient and soft enough to also function as a cutting mat. Thus, suitable types of plastic, elastomers, polymers, and other synthetic material or rubber of suitable hardness, elasticity, flexibility, and strength may be used to form the stitching guide 20 as is known in the art.

Figure 4:
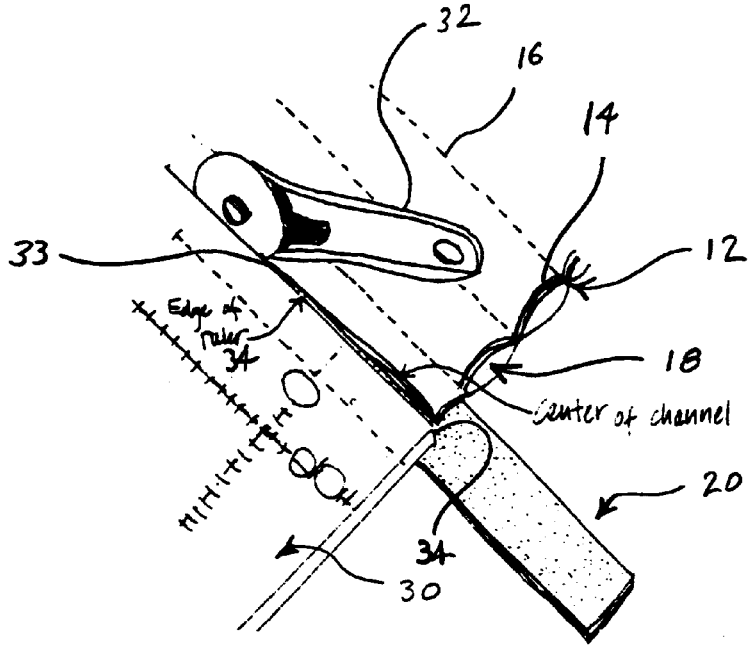
FIG. 4 is an isometric projection of a rotary cutting tool used in conjunction with the stitching guide of the invention to slash between the rows of stitching.

FIG. 4 illustrates a method for cutting or "slashing" the channeled layers of cloth 14 to form a chenille-type look and feel to the stack of fabric 12. Hence, the stitching guide 20 is inserted within a channel 18, as shown in FIG. 2. A ruler, such as the OMNIGRID® ruler 30 can be used to guide the rotary cutter 32 down the channel 18.

Figure 5:
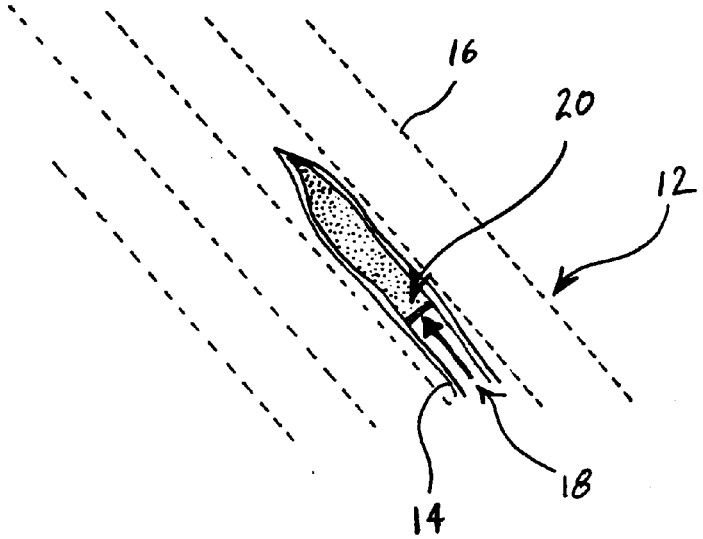
FIG. 5 illustrates adjusting the position of stitching guide along the cloth channel as the cloth between the rows of stitching is slashed.

If the stitching guide 20 is not of sufficient length to extend the entire length of the channel 18, it will need to be moved further up the channel as the cloth 14 is slashed. This is shown in FIG. 5, where the stitching guide 20 is slid up the channel 18.

When making chenille-type fabric with narrow channels, it is preferred to use four fabric layers of cloth 14 in the stack of fabric 12. Any bold design in the top fabric will remain discernible when using smaller channels, as the design is not as distorted using the narrower channels. Overlays on the top layer of fabric (such as flowers, geometric designs, etc.) will also show the design, enabling each pattern to be unique.

As an example, the stack of fabric 12 shown in FIG. 1 comprises multiple layers of square cloth 14. Ideally, the layers of cloth are stacked so that the grain lines are matched in each layer.

The rows of stitching 16 should always be done at a 45 degree angle to the straight of the grain. If the rows 16 are stitched without the aid of the stitching guide 20, a little extra width between the stitched rows 16 should be left to insert the stitching guide 20 into the channels 18 at a later stage to function as a cutting mat. It is recommended that a one-half inch amount of material be left between the stitching rows for the three-eighths inch wide stitching guide 20; three-eighths of an inch should be left for the five-sixteenth inch wide stitching guide 20 and five-sixteenths of an inch should be left for the one-quarter inch wide stitching guide 20.

Next, the stitched project should be spread out on a cutting mat right side up. The correct sized stitching guide 20 in then inserted within the channel 18, preferably on top of the base layer 22 and below the other layers 23 of cloth 14. However, the guide 20 can be selectively inserted in the channel 18 to rest upon the base layer 22 and one or more of the other layers 23 of cloth 14, which enables cutting or slashing of the remaining layers 23 of the cloth.

As described above with respect to FIG. 3, if the comers of the stitching guide 20 interfere with insertion into the channels, heavy-duty nail clippers 28 may be used to snip off the sharp angles of the comers 26 or to round out the comers 26. A nail file or emery board may also be used to make a smooth, tapered end 24 that avoids snagging the cloth.

The OMNIGRID® ruler 30 is then placed between the stitched rows and aligned with the long edge 34 of the ruler 30, preferably over the center of the channel 18 and the now-inserted stitching guide 20. A cut or slash 33 is slowly and carefully made with the rotary cutter 32 through the fabric layers of cloth 14 using the edge 34 of the ruler 30 as a cutting guide.

If the stitching guide 20 is of insufficient length, the slash 33 preferably should be made to within three-quarter inch to one-inch from the end of the stitching guide 20. The stitching guide 20 is then slid further into the channel 18. This is repeated until the edges of the layers of cloth 14 are reached. The foregoing steps are repeated until all of the channels 18 have been slashed.

Figure 6:
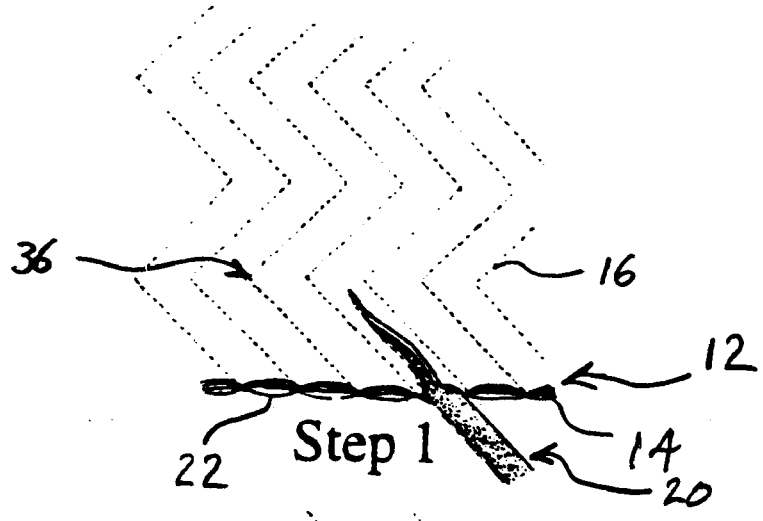
FIG. 6 is an isometric projection of an alternative embodiment of the method of the invention wherein zig-zag channels are formed.
Figure 7:
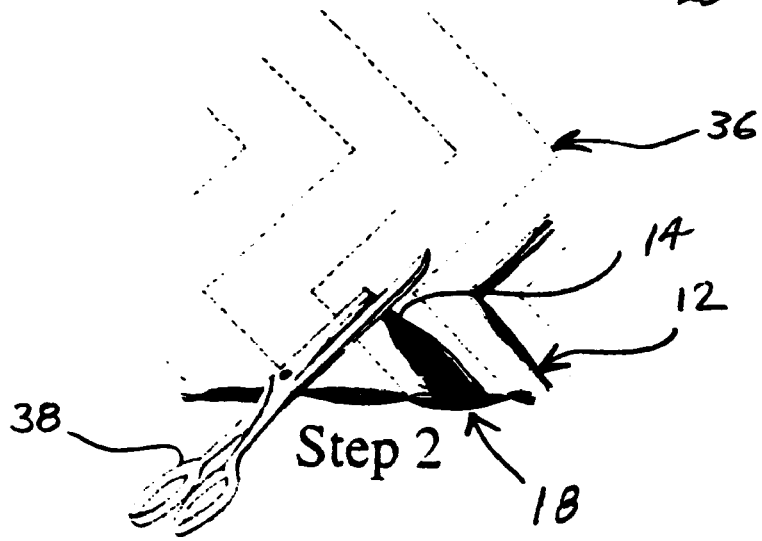
FIG. 7 is an illustration of slashing one leg of a 90 degree turn in a channel.
Figure 8:
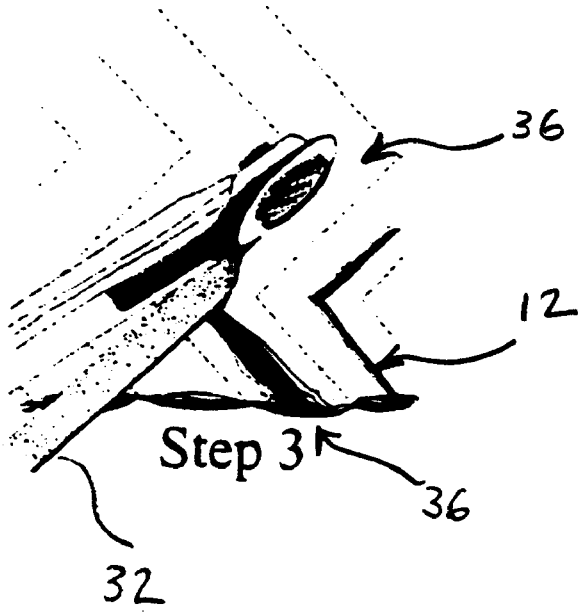
FIG. 8 is an isometric projection showing a continuation of the method of FIG. 7 wherein a second leg of slashing is accomplished in accordance with the invention.

Referring next to FIGS. 6–8, if the project has short, zig-zag channels 36, the stitching guide 20 is inserted until the channel 36 changes angles. After the cloth 14 is slashed, the stitching guide 20 is repositioned to the next angle and the cloth 14 is slashed again. Scissors 38 may be required to snip the cloth 14 at the transition of the channel 36 in order to facilitate reinsertion of the stitching guide 20 in the channel 36 at the new angle of orientation.

Figure 9:
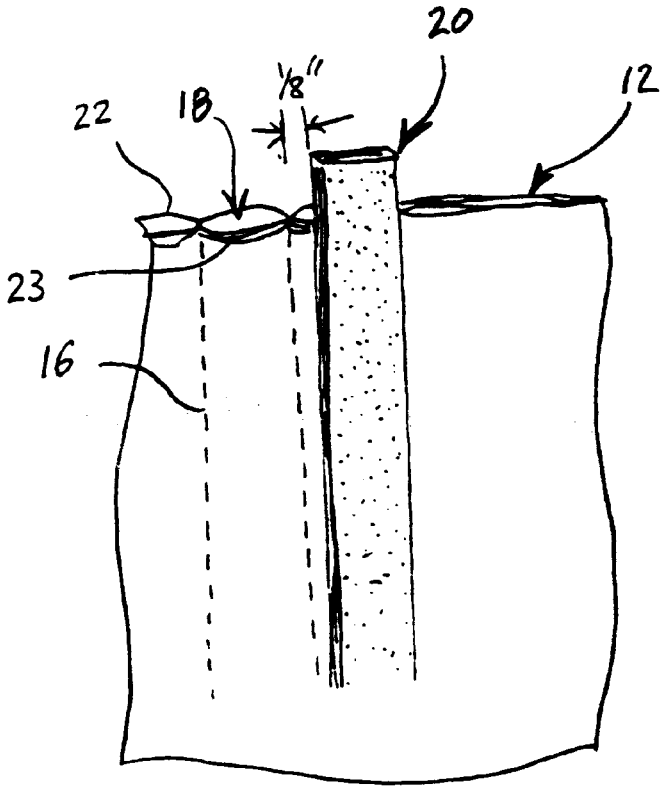
FIG. 9 is an isometric projection of another method of the invention wherein a stitching guide is used to form multiple channels between parallel rows of stitching on multiple layers of fabric.
Figure 10:
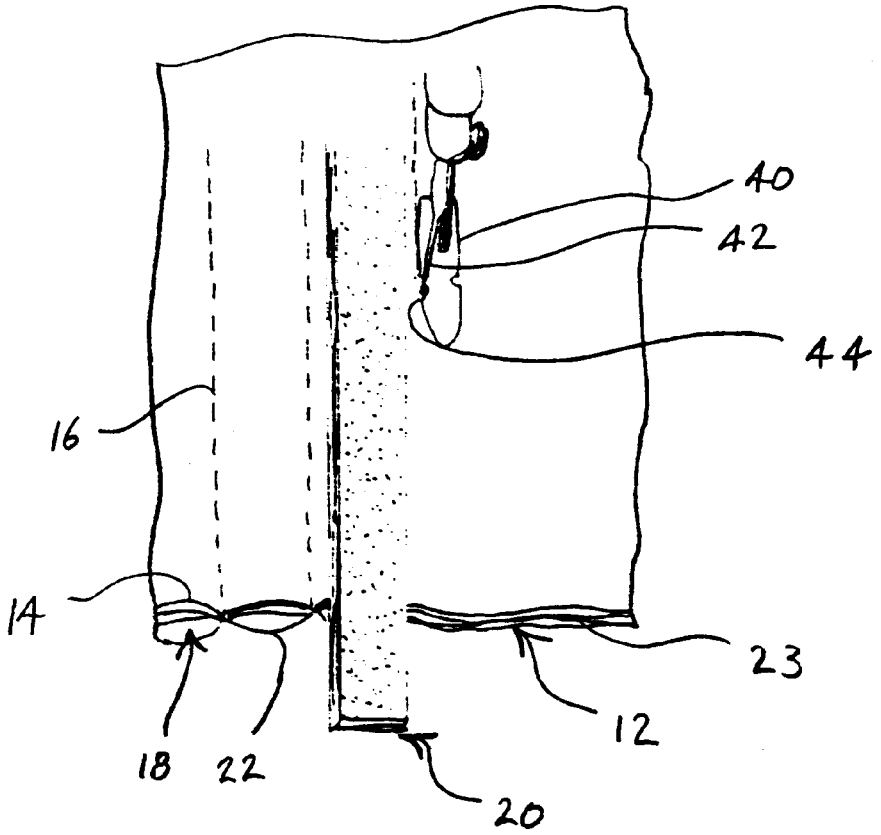
FIG. 10 is an isometric projection of the method of FIG. 9 showing the correct placement of a sewing machine foot in relationship to the stitching guide in accordance with the method of the invention.

The stitching guides 20 can be used in conjunction with a sewing machine to sew the channels 18 in the stack of fabric 12, as illustrated in FIGS. 9–10. At a sewing machine (not shown), the stack of fabric 12 having one row of stitching 16 already formed therein, is placed under the zipper foot, and the stitching guide 20 is positioned approximately one-eighth inch from the initial row of stitching 16.

With the zipper foot 40 on the sewing machine, the needle 42 is positioned next to the edge 44 of the zipper foot 40 and then next to the stitching guide 20 on top of the stack of fabric 12. Enough room should be left for the needle to stitch the stack of fabric 12.

It is important to leave a little extra width between the stitching rows to accommodate the thickness of the stitching guide 20, as previously described. The row of stitching is then created by running the edge of the zipper foot close to the stitching guide 20. Thus, straight, parallel rows of stitching are created to form channels 18 of uniform width.

While various embodiment of the invention have been illustrated and described, it is to be understood that various changes may be made therein without departing from the spirit and scope of the invention. For example, the stitching guide 20 can also be used in craft projects to produce doll hair or fringe. This is accomplished by wrapping yarn, twine, hemp, wool, embroidery floss, etc., numerous times around the stitching guide 20, then pressing ¼ inch heat-activated adhesive strip, such as the commercially-available Steam A Seam2®, along the middle of the back of the wrapped fiber. The fiber-wrapped stitching guide 20 is then turned over and a ruler is aligned in the middle of the stitching guide 20. A rotary cutter is then run along the middle of the stitching guide 20 using the ruler as a cutting guide. After the fibers are cut, they easily are removed from the stitching guide 20, resulting in a fringe that can be readily attached with the application of heat, such as 10 to 15 second application of heat from a steam iron. The stitching guide 20 may also be used for tucks, pleats, purses, hand bags, make-up bags, and home decorating projects such as pillow appliance covers, place mats, rugs, and quilts.

The embodiments of the invention in which an exclusive property or privilege is claimed are defined as follows:

1. A method for forming textured material, comprising:

sewing multiple layers of fabric along a first line to form a first row of stitching;

placing a template on the multiple layers of fabric with a first edge of the template adjacent to the first row of stitching;

sewing the multiple layers of fabric along a second line adjacent to a second edge of the template to form a second row of stitching and at least one channel between the first and second rows of stitching in the multiple layers of fabric.

2. The method of claim 1, further comprising:

inserting the template into the channel beneath at least one layer of the multiple layers of fabric; and using the template as a cutting surface and cutting the at least one layer of fabric on top of the template with a cutting tool.

3. The method of claim 2 wherein cutting comprises using a rotary cutter to cut the at least one layer of fabric.

4. The method of claim 2 wherein cutting further comprises placing a cutting guide on top of the fabric and with an of the cutting guide positioned over the template in the channel, and guiding a cutting tool with the edge of the cutting guide.

5. The method of claim 4 wherein cutting further comprises using a rotary cutter as the cutting tool.

6. The method of claim 1 wherein sewing along a second line comprises comprises placing the edge of a sewing machine foot with the needle adjacent the template and sewing the row of stitching with the sewing machine needle while using the template as a guide.

7. The method of claim 2, comprising forming multiple channels in the multiple layers of fabric.

8. The method of claim 7 wherein the channels are formed to be parallel to one another.

9. The method of claim 7 wherein the channels are formed in a zig-zag pattern.

10. A method for forming textured material using a cutting strip having a pair of opposing parallel first and second sides, the method comprising:

providing multiple layers of fabric;

forming a row of stitching through the multiple layers of fabric;

placing a cutting strip on the multiple layers of fabric with a first side of the cutting strip adjacent the row of stitching;

forming a next row of stitching adjacent the second side of the cutting strip to form a channel in the multiple layers of fabric.

11. The method of claim 10 wherein providing multiple layers of fabric comprises providing a base layer of fabric and least one top layer of fabric placed over the base layer of fabric.

12. The method of claim 1, further comprising inserting the cutting strip into the channel on top of at least the base layer of fabric and cutting through the remaining layers of fabric on top of the cutting strip.

13. The method of claim 12 wherein cutting comprises running a rotary cutting tool over the remaining layers of material and the cutting strip.

14. The method of claim 10, further comprising placing the cutting strip adjacent the next row of stitching and sewing a further next row of stitching to form another channel.

15. The method of claim 14, further comprising repeating the placing of the cutting strip and sewing another next row of stitching to create multiple channels.

16. The method of claim 15, further comprising inserting the cutting strip into selected channels and beneath selected layers of fabric and cutting the selected layers of fabric.

17. The method of claim 16 wherein cutting comprises placing a cutting guide on the multiple layers of fabric and over the cutting strip so as to guide a cutting tool.

18. The method of claim 16 wherein cutting comprises slashing the selected layers of material with a rotary cutter tool while using the cutting strip as a cutting mat to support the rotary cutting tool and protecting material underneath the cutting strip.

19. The method of claim 18 wherein cutting comprises placing a cutting guide on top of the selected layers of material and the cutting strip and using the cutting guide to guide the rotary cutting tool.

20. A device for guiding stitching and supporting a cutting tool for use in sewing and cutting multiple layers of fabric, the device comprising a rectangular-shaped strip of compliant material having sufficient rigidity to be at least partially self supporting when projecting beyond the end of a supporting surface, the device having planar top and bottom surfaces and a pair of mutually-opposing parallel sides intersecting with opposing top and bottom sides to form corners.

21. The device of claim 20 wherein at least the two corners formed by one of either the top side and the bottom side are rounded to facilitate insertion of the device into a channel formed between layers of fabric without catching and snagging on the fabric.

* * * * *

UNITED STATES PATENT AND TRADEMARK OFFICE

CERTIFICATE OF CORRECTION

PATENT NO. : 6,199,495 B1
DATED : March 13, 2001
INVENTOR(S) : Margaret D. Schafer It is certified that error appears in the above-identified patent and that said Letters Patent is hereby corrected as shown below:

Column 5,
Lines 64 and 63, "second line comprises comprises placing" should read --second line comprises placing--.

Column 6,
Line 24, "The method of claim 1," should read -- The method of claim 11,--.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*